US007918092B2

(12) United States Patent
Lin et al.

(10) Patent No.: US 7,918,092 B2
(45) Date of Patent: Apr. 5, 2011

(54) ENHANCED THERMOELECTRIC COOLER WITH SUPERCONDUCTIVE COOLERS FOR USE IN AIR-CONDITIONERS

(76) Inventors: I-Ming Lin, Walnut, CA (US); Fu-Hsing Hsieh, Taipei (TW)

( * ) Notice: Subject to any disclaimer, the term of this patent is extended or adjusted under 35 U.S.C. 154(b) by 87 days.

(21) Appl. No.: 11/725,207

(22) Filed: Mar. 19, 2007

(65) Prior Publication Data

US 2008/0229758 A1 Sep. 25, 2008

(51) Int. Cl.
*F25B 21/02* (2006.01)

(52) U.S. Cl. ..... 62/3.7; 62/3.3

(58) Field of Classification Search ..... 62/3.2, 62/3.3, 3.7

See application file for complete search history.

(56) References Cited

U.S. PATENT DOCUMENTS 6,755,026 B2 * 6/2004 Wallach ..... 62/3.7

* cited by examiner

*Primary Examiner* — Melvin Jones

(74) *Attorney, Agent, or Firm* — Raymond Y. Chan; David and Raymond Patent Firm

(57) ABSTRACT

This is an enhanced thermoelectric cooler with superconductive heat-dissipative coolers for use in air-conditioner. This invention is comprised of a thermoelectric cooling chip sandwiched between two superconductive unidirectional heat-dissipative cooling devices. Each device consists of special superconductive pipes, heat-dissipative plates, and a fan. The cooling devices are to dissipate heat quickly from the thermoelectric cooling chip and to maintain constant hot to cold air flow.

18 Claims, 6 Drawing Sheets

Cross-section pipe view

Mid-cut pipe view

ENHANCED THERMOELECTRIC COOLER WITH SUPERCONDUCTIVE COOLERS FOR USE IN AIR-CONDITIONERS

BACKGROUND OF THE INVENTION

The current air-condition devices commonly used at home/car/industry are often large, require large amount of electricity, and slow in performance. A research project was conducted to use the energy-efficient thermoelectric cooling method to enhance air-conditioner. Thermoelectric cooling idea consists of heat is absorbed from first side to the second side, leave the first side cold. The use of thermoelectric cooling is common in everyday life, but its use in home or car air-conditioning poses a challenge to the current technology. Two major issues hinder thermoelectric technology from use in large-scale air-conditioning devices. First is the lack of an effective method for dissipating heat from the thermoelectric cooling chip. Second is the fact that traditional heat pipes cannot function under 5 degrees Celsius, thereby crippling the conduit for the device to deliver cold air. By using our invented thermal superconductive heat pipes, we found a solution for both issues, creating a means for thermoelectric cooling technology to find its way to the masses.

SUMMARY OF THE INVENTION

This is an enhanced thermoelectric cooler with thermal superconductive coolers to use in air-condition devices. This invention is comprised of a thermoelectric cooling chip sandwiched between two superconductive unidirectional heat-dissipative cooling devices. The two coolers will face opposite of each other, with one's fan facing up and one's fan facing down. Each cooler consists of special superconductive heat pipes, heat-dissipative fins (plates), chassis mold and a fan. The thermoelectric cooling chip moves heat onto one side, causing the other side to become cold. The superconductive cooler on the chip's hot side quickly dissipates heat, allowing the cold side to chill rapidly. The superconductive cooler on the chip's cold side uses a different chemical formulation, allowing rapid heat conduction even at relatively low temperatures. The result is a device that draws ambient air, quickly transfers the air's heat to the far end of the device, and expels the now drastically cooler air. With our new invention of superconductive vacuum cooler, the heat is dissipated unidirectional in our specialized metal pipes with liquid chemical formula. Our invention does not need the full cycle to dissipate heat. The heat flows in one direction (toward the cooler end) and the cooler does not require cold air to stream down to the device being cooled. The fan is located on the top of the heat-dissipative fins, forcing the cold air out of the fins. This invention revolutionized air-conditioner to have better performance, better design, less space consumption, and competitive cheaper pricing. Unlike conventional air-conditioners, this device does not need compressors or coolant, thereby creating an environmentally friendly, energy-efficient solution for home, industrial, and automotive air-conditioning systems. This invention only consumes a third of the power of conventional air-conditioners.

BRIEF DESCRIPTION OF THE DRAWINGS

The numbers in the figures are explained further in the specification.

FIGURE EXPLANATIONS

Figure 1:
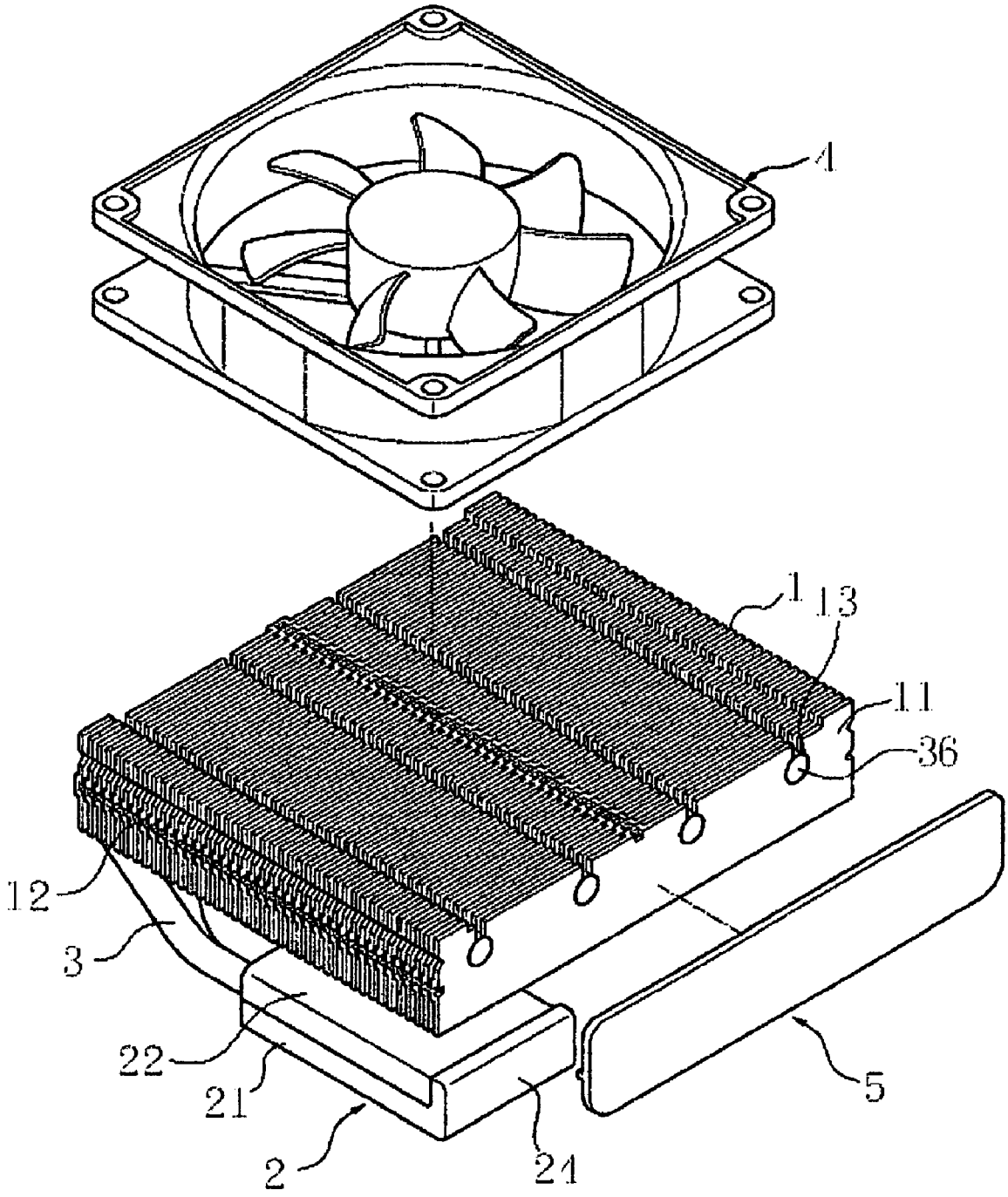
FIG. 1—Disassembled superconductive vacuum cooler package view.

Heat-dissipative fins (plates) mould (1); Chassis mould module (2); Thermal superconductive heat pipes (3); Cooling fan (4); Metal end cover (5); Single heat-dissipative fin (plate) (11); Separation buttons (12); Heat-dissipative fin pipe hole (13); Fixed chassis in chassis mold module (21); Top cover for chassis mold module (22); Heat pipe grooves (23); Front cover for chassis mold module (24); Heat pipe metal tube (31); Heat pipe metal net for inner core (32); Heat pipe metal balls in the peripheral core (33); Thermal superconductive chemical liquid in the peripheral core (34); Heat pipe surface membrane (35); Heat pipe ends (36); Thermoelectric Cooler Chip (37); Superconductive cooler to dissipate heat from the thermoelectric cooling chip (38); Superconductive cooler to dissipate heat from air and blows cold air (39)

INVENTION DETAILS

Figure 6:
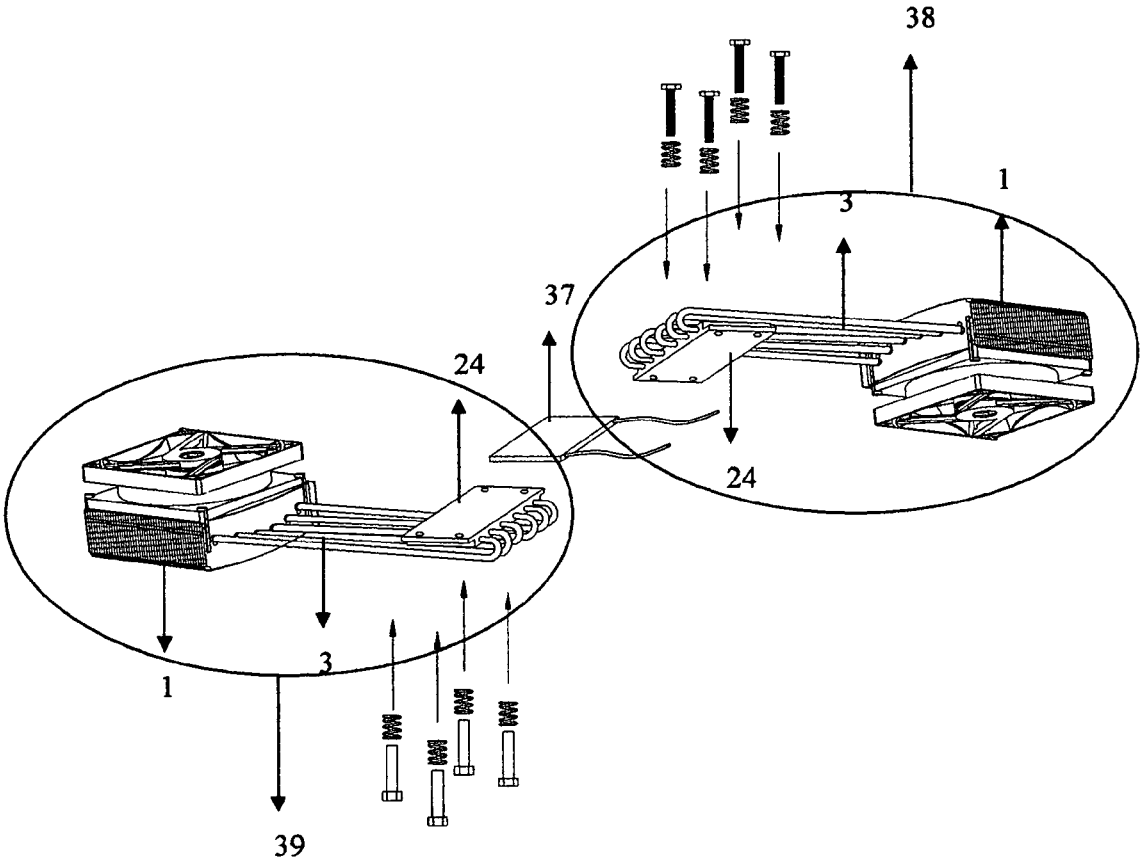
FIG. 6—Disassembled thermoelectric cooler with thermal superconductive cooler for use in air-condition devices view.
Figure 7:
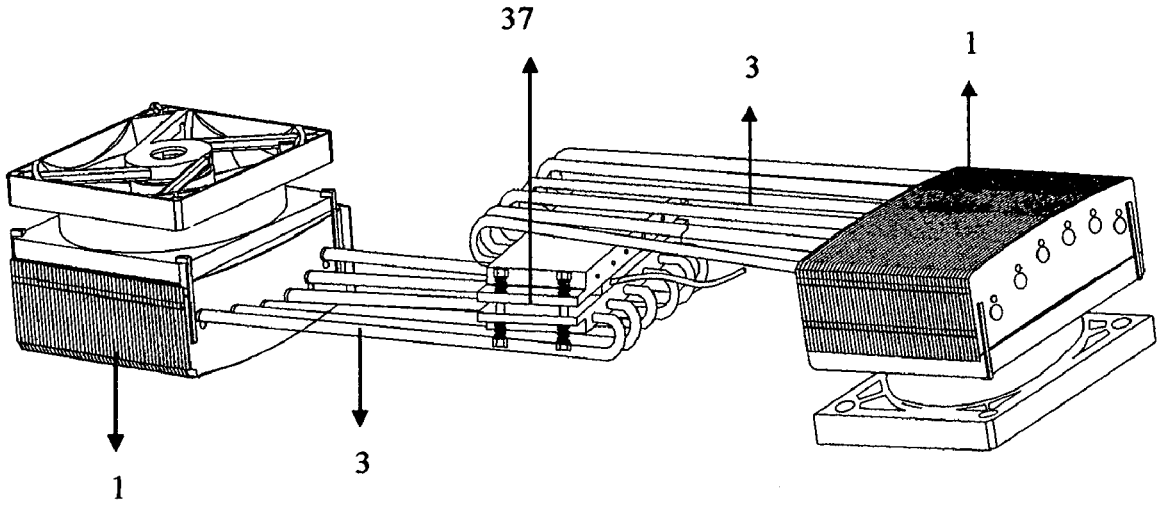
FIG. 7—Assembled thermoelectric cooler with thermal superconductive cooler for use in air-condition devices view.

Please view FIGS. 6 and 7: This invention consists of a thermoelectric cooling chip (37) inserted between two thermal superconductive unidirectional heat-dissipative cooling devices (38 and 39). The thermoelectric cooling chip (37) moves heat onto one side, causing the other side to become cold. One thermal superconductive heat cooler (39) is attached to the colder side of the thermoelectric cooling chip and the other cooler (38) is attached to the hotter side. The two superconductive coolers (38 and 39) will face opposite of each other, with each fan (4) blowing toward its heat-dissipative fins (1). Each cooler consists of special superconductive heat pipes (3), heat-dissipative fins (1), chassis mold module (2) and a cooling fan (4). The superconductive cooler on the chip's hot side (38) quickly dissipates heat, allowing the cold side (opposite side) to chill rapidly. The superconductive cooler on the chip's cold side (39) uses a different chemical formulation to set the heat pipe temperature to be very low (below 0° C. Celsius), allowing rapid heat conduction even at relatively low temperatures. Hot air is absorbed from the fan (4) from the cooler on the cold side (39) into its heat-dissipative fins (1). Due to the heat pipe's (3) low temperature setting (below 0° C. Celsius), the hot air and cold pipes will cause heat energy conduction and move the heat to the colder end near the thermoelectric cooling chip (37) where the heat is absorbed, causing the chip on the opposite side to be hotter. The cooler on the hot side (38) does not need to set the pipe temperature as low as the cool side due to the high temperature of the hot thermoelectric cooling plate, but it is still low enough (can be adjusted freely with the use of chemical formula) to rapidly absorb heat from the thermoelectric cooling chip (37) and conduct the heat to the heat dissipative fins (1), where cooling fan (4) constantly blow on the fins to cool down the temperature. The liquid chemical formation can be adjusted to achieve higher or lower temperature conduction.

The air blown from the fan (4) of the cooler on the cold side (39) will be cold air, thus creating an air-conditioning device. The result is a device that draws ambient air from the cooler on the cold side (39), quickly transfers the air's heat to the far end of the device (38), and expels the now drastically cooler air.

Please view FIGS. 1 to 7 as noted.

Figure 3:
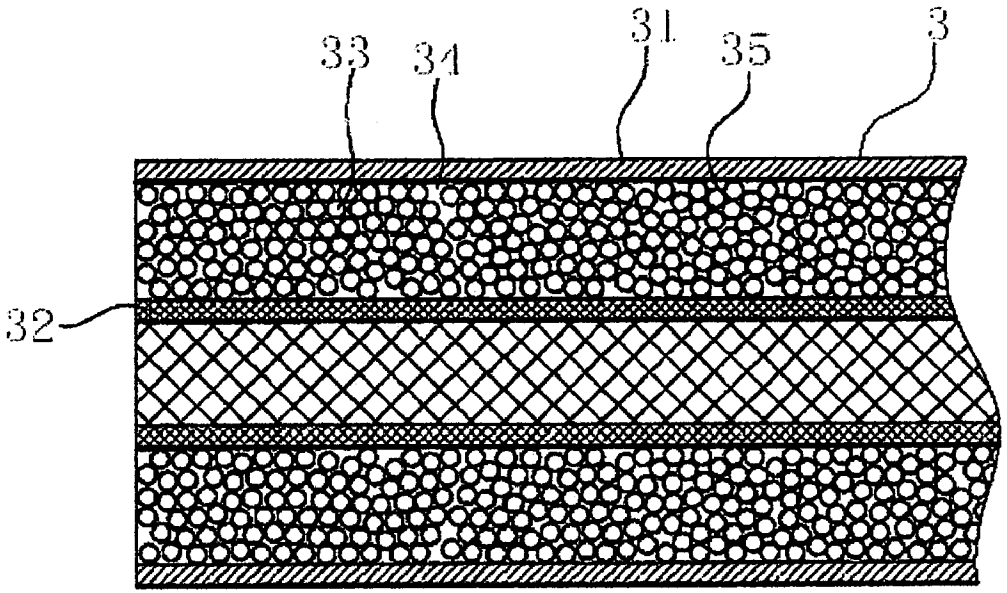
FIG. 3—Cross-section pipe interior view. This figure shows the side cut view of the pipe interior.
Figure 4:
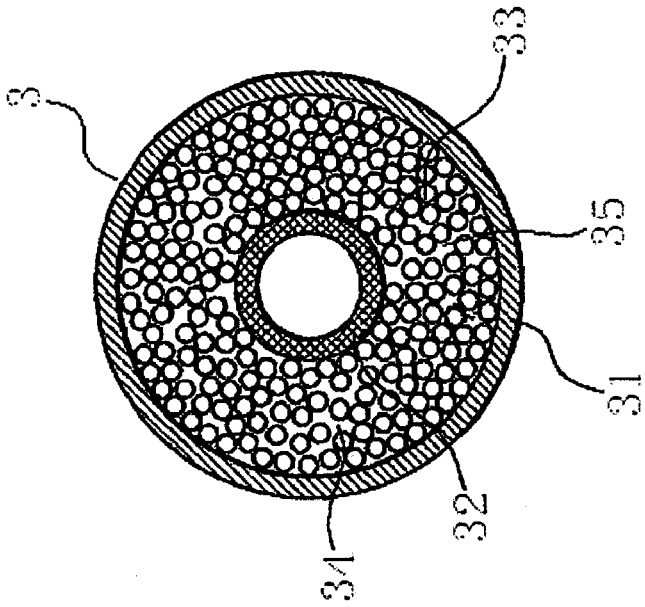
FIG. 4—Mid-cut pipe interior view. This figure shows the center-cut view of the metal pipe interior.
Figure 5:
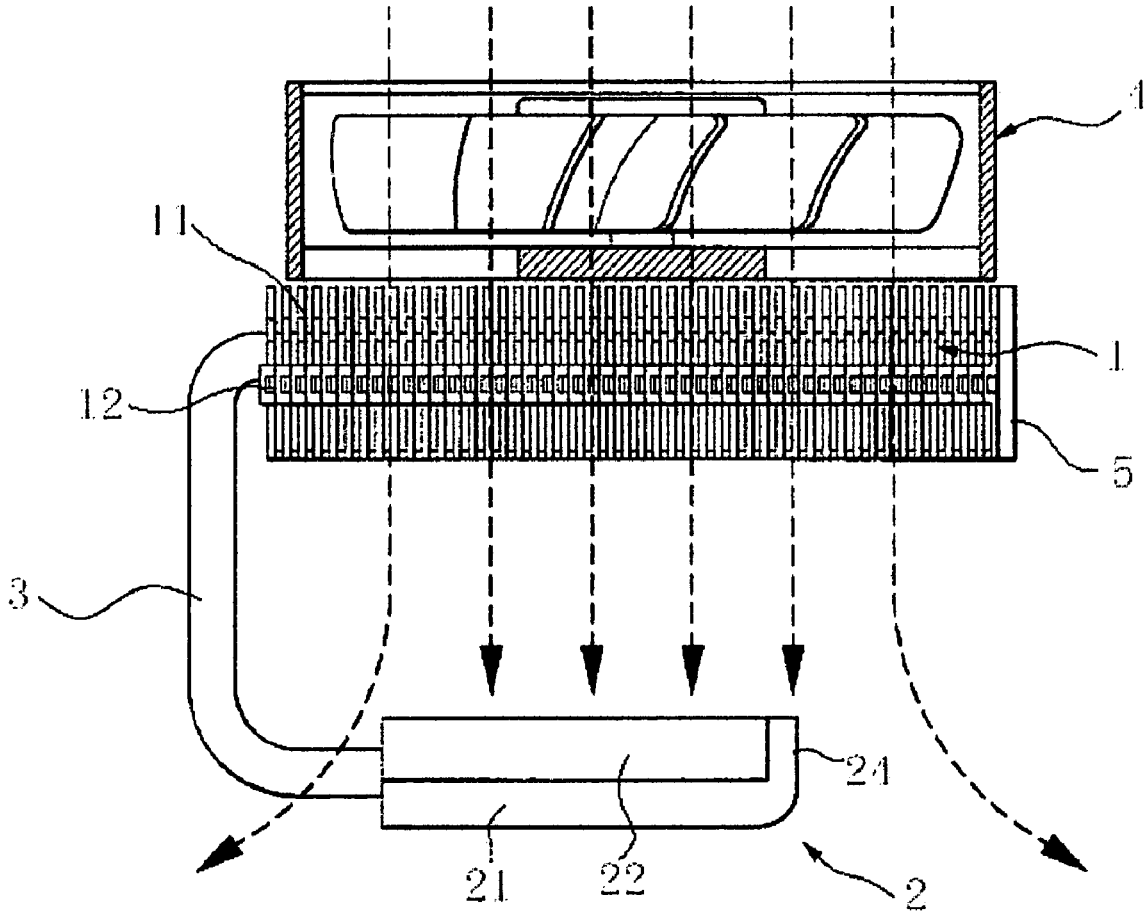
FIG. 5—Assembled thermal superconductive cooler view.

1) Thermal superconductive heat pipes (3): please view FIGS. 1, 3 and 4. The heat pipes (3) travel through the heat pipe holes (13) of the heat-dissipative fins (1) and ends at heat pipe ending point (13). The heat pipes (3) will be exposed outside of the last heat-dissipative fin (11), forming heat pipe ends (36). (Copper/aluminum) metal tube (31), thin (copper or aluminum) metal net (32) and thin (copper or aluminum) metal balls (33) are joined together to create the thermal superconductive pipes (3). The metal net (32) lines the inner core wall while the metal balls (33) fill the peripheral outer core. After vacuum treatment, many different liquid formulas are mixed to form the superconductive chemical liquid (34) and are injected into peripheral core of the heat pipes (3). The heat pipe's openings (36) will then be sealed. This design conducts various experiments from the various types of conductive liquids; the end result on the invented chemical can rapidly convey heat energy from hot to cold. This improves the conventional single liquid design heat sink that needs to perform a whole cycle through the heat pipes (up to the fan and down to the device being cooled) to reach the same performance. The superconductive chemical mixed liquid (34) will form a distributed surface membrane (35) among the metal balls (33) and the metal net (32). The distributed surface membrane in the peripheral core will move to push and shove each other, thus conducting heat energy when it is reacting with a hotter temperature. The heat energy is moved from the hot end to the colder end as conduction is defined. The metal balls and metal net are close to the inner vacuum core of the metal tube (31), causing the superconductive liquid (34) to move freely in the pipes due to no weight and no pressure (due to inner core is a vacuum). The success rate reaches 98% of heat dissipation result.
   1. Due to the formation of the surface membrane (35) and superconductive nature, the superconductive heat pipes (3) can be set at any angle; it is not limited by the original design of single liquid in the metal pipe moving heat upward and cold air moves downward. The heat energy will always move toward the cold end. This invention will increase in usage. The item can be applied in various cooling devices in various industries.
      i. Due to the invented chemical formula (34) can be changed by proportion and material, the temperature of the inner heat pipe can be adjusted freely from −76° C.~+1200° C. The chemicals are: H.O.Na, K2.Cr.O4, Ethanol, H2O (water) and etc. . . . The formulas were utilized according to lab measurements.
      ii. The thermal superconductive heat pipe (3) has an effective heat dissipation distance range freely from 10 cm to 2 km. This functionality will achieve long distance application performance.

2) The heat-dissipative fins (1) are created with superconductive materials. This invention utilizes the distance between separation buttons (12, little bumps on one fin to collapse into another fin) to evenly distribute the heat-dissipative fins (1). Each heat-dissipative fin (11) will have various evenly distributed pipe holes (13) that allow superconductive metal pipes (3) to go through. This causes the heat traveling through the metal pipes to be distributed among the fins (1). The cooling fan (4) will then blow on the fins (1), thus dissipating the heat. At the end fin (11) and the end of the heat pipes (36), a metal end cover (5) is designed to not concentrate heat from the heat pipes at the end of the heat-dissipative fins (1). The metal end cover (5) is designed to spread the heat from the end of the superconductive heat pipes (3), thus increases the performance of heat dissipation. This invention of the metal end cover (5) will help the cooling plates to increase its performance.

Figure 2:
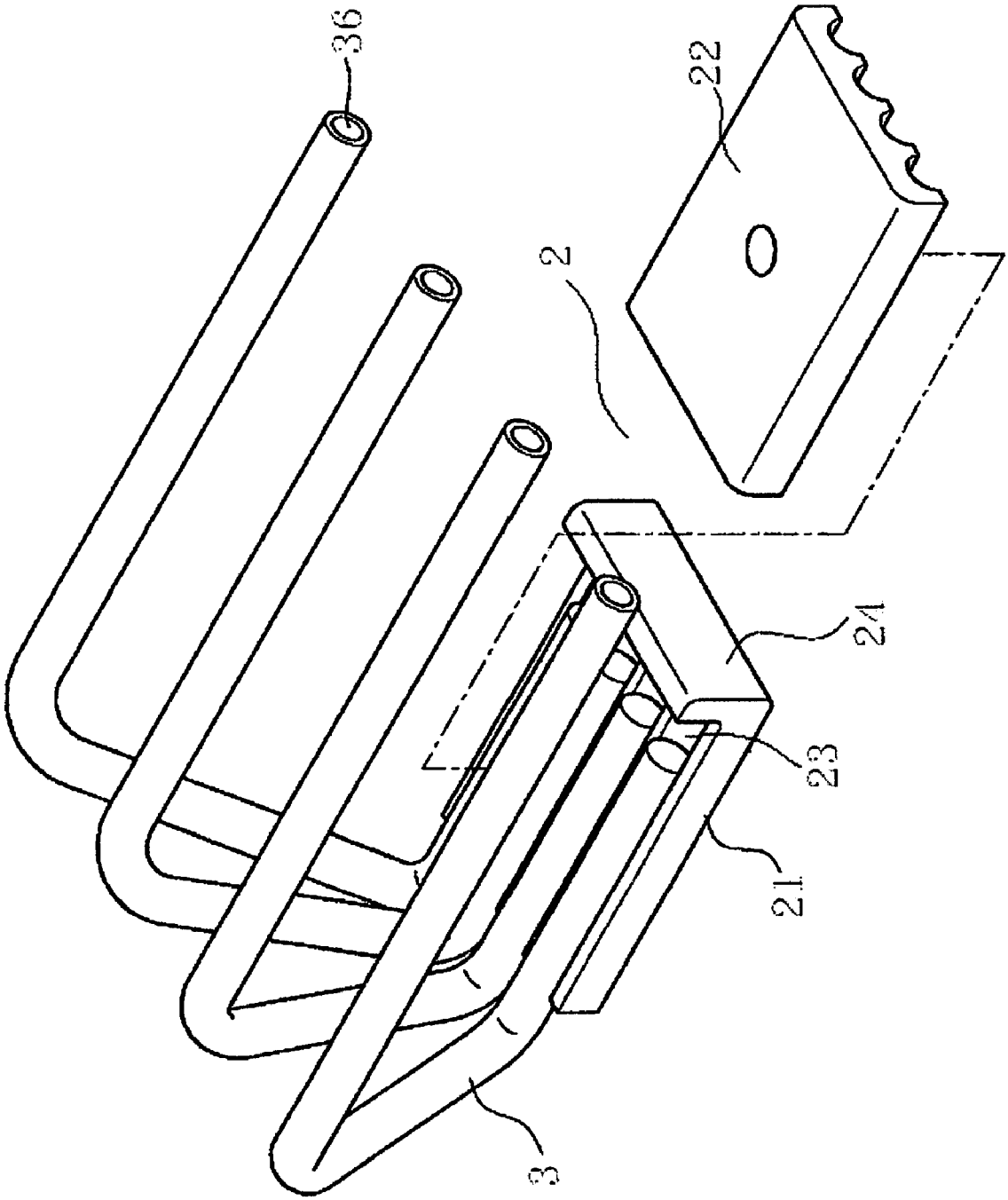
FIG. 2—Bracket and tube grooves view of the package. This figure shows the disassembled inner part of the metal bracket and tube.

3) Chassis mold module (2): the chassis mold module is the main conductor between the thermoelectric cooling chip (37) and the superconductive metal pipes (3). This conductor is the main relation that causes the thermoelectric cooling chip (37) heat to spread speedily to the superconductive metal pipes (3). This chassis mold module (2) utilizes high temperature and high pressure trimming to form its shape. The metal particles will be compressed to be more compact, thus the spacing between the metal components will be reduced. The content of air is reduced (air is the main factor that separates the heat conduction), the thermal resistance coefficient is reduced, and the heat conduction result is improved. The chassis mold module (2) comprises of the support fixed chassis (21) and top cover (22) and front end cover (24). As shown in FIG. 2, the heat pipes groves (23) are created to snugly combine the superconductive heat pipes (3) with the fixed chassis mold (21). The fixed chassis mold (21) and the top cover (22) is used to secure superconductive heat pipes (3) in the chassis mold module (2). The chassis mold module (2) is placed on the article to cool; it will lock its position in the electronic devices. The invented front cover (24) cover will make the end surface smooth. In this case, we do not need to adjust the heat pipes ends to the same length. This will cause fast and easy assemble process that will save manpower and man-hour. The front cover (24) will close the chassis mold module tip (2) and prevent exposition of the heat pipes (3). The front cover (24) benefits include:
   (a) The package will be leveled at the time of production; it does not need to be aliened, saving manpower sparingly.
   (b) It prevents chassis mold module (2) heat energy from spreading. The superconductive heat pipe (3) end tips will become heat conduction invalid area. The use of the front cover (5) will eliminate the useless area, thus increasing heat dissipation.

4) The cooling fan (4) is used to blow the heat from heat-dissipative fins (1). In the case of the superconductive cooler attached to the cold end (39) of the thermoelectric cooling chip (37), the air blown out will be cold air.

5) The combination of two superconductive coolers (38 and 39) with a thermoelectric cooling plate (37) results in an enhanced thermoelectric cooler that can effectively generate cold air. The idea of thermoelectric cooling is to absorb heat quickly from one side to the other side, thus making one side cold. The invention utilizes this idea by placing one superconductive cooler (39) on the cold side and one superconductive cooler (38) on the hot side. Hot air absorbed from the outside air from a cooling fan (4) of the cooler on the cold side (39) is spread among the heat dissipative fins (1) and the heat pipes (3). Due to the fact that the cold side's heat pipe chemical formula is adjusted to a very low temperature (below 0° C. Celsius), the hot air meeting the cold pipes (3) will cause heat energy creation. The heat later travels to the thermoelectric cooling chip (37) that will absorb the heat to the opposite side. The air will immediately be cooled down when blown out of the heat-dissipative fins (1). The test result showed that the invention can effectively produce cold air down to 0° C. or lower. The heat on the hot side of the thermoelectric cooling chip (37) will then be dissipated using another superconductive cooler (38). The chemical formula for these heat pipes (3) is adjust to a higher temperature than the colder side due to the heat from the hot side of thermoelectric cooling chip is very hot. The heat will be dissipated rapidly using this superconductive cooler (38).

PATENT MATERIALS INCLUDE

1) Enhanced thermoelectric cooler with two thermal superconductive coolers for use in air-condition devices. The patent includes the use of thermoelectric cooling chip sandwiched between the two superconductive coolers to generate cold air.
2) Thermal superconductive cooler with the following main components: (please see FIGS. 5, 6 and 7).
   a. Heat-dissipative fins
   b. Chassis mold module
   c. At least one superconductive heat pipe
   d. Cooling fan
3) Metal End cover: located at the last heat-dissipative fin; this is where the superconductive heat pipes ends.
4) The chassis mold module and its materials: created with superconductive materials to form empty middle area to allow the connection of the superconductive heat pipes.
5) The front cover of the chassis mold module: This is where the chassis mold module and the heat pipes connect. The cover will cover the heat pipes end to allow better heat spread and thus enhancing heat dissipation.
6) At lease one pipe groove in chassis mold module.
7) Superconductive heat pipes: After vacuum treatment, many different chemical liquid formulas are mixed to form the superconductive liquid and are injected into heat pipes. The openings will then be sealed. The materials include:
   e. Copper or aluminum metal tube
   f. Copper or aluminum metal net
   g. Copper or aluminum metal balls
   h. Superconductive chemical mixed liquid
8) Surface membrane in superconductive heat pipes: Copper or aluminum tube, thin copper or aluminum net and thin copper or aluminum balls are melted to join together to create the conductive pipes. The surface of the melted materials will become the surface membrane.
9) The superconductive liquid formed with mixed chemicals. The chemicals are: H.O.Na, K2.Cr.O4, Ethanol, H2O (water) and etc. . . . The chemicals are utilized according to lab measurements.
10) The superconductive liquid formula could be changed according to materials and change of measurements. Due to the materials of the superconductive liquid can be changed by proportion and material, the temperature can be adjusted freely from −76° C.~+1200° C.

The components of this invention in which an exclusive property or right is claimed are defined as follows:

1. A thermal superconductive cooler inside air-conditioner, comprising a vacuum superconductive heat pipe containing chemical liquid inside the heat pipe, wherein the chemical liquid is a mixture selected from the group consisting of H.O.Na, $K_2CrO_4$, Ethanol, and $H_2O$, and is operated at a temperature in a range from −76° C. to 1200° C. and transmit to a range of 2 km.

2. The thermal superconductive cooler, as recited in claim 1, wherein said heat pipe transmits heat from end-to-end in unidirectional direction, wherein said chemical liquid in said heat pipe converts heat energy from hot to cold without requiring full heat dissipating cycle.

3. The thermal superconductive cooler, as recited in claim 1, further comprising a metal end cover positioning at one of said end of said heat pipe for spreading heat from said end of said heat pipe so as to prevent heat from being accumulated at said end of said heat pipe.

4. A heat dissipative cooling device for use in air conditioning system, comprising:

one or more heat pipes with vacuum interior, wherein each of said heat pipes is filled with chemical liquid as a mixture selected from the group consisting of H.O.Na, $K_2CrO_4$, Ethanol, and $H_2O$, and being operated at a temperature in a range from −76° C. to 1200° C., wherein each of said heat pipes has a first end and an opposed second end and is arranged for transmitting heat from end-to-end in unidirectional direction;

a plurality of heat dissipative fins coupling at said first end of each of said heat pipes for heat conduction; and a fan operatively linked to said heat dissipative fins for generating an air flow thereto.

5. The heat dissipative cooling device, as recited in claim 4, wherein each of said heat pipes comprises a metal tube, a tubular metal net coaxially disposed within said metal tube, and a plurality of metal balls disposed between an inner side of said metal tube and an outer side of said metal net, wherein said chemical liquid is filled in said metal tube to move freely in said vacuum interior and to form a distributed surface membrane on each of said metal balls and said metal net for heat conduction.

6. The heat dissipative cooling device, as recited in claim 4, wherein each of said heat dissipative fins has a heat dissipative fin pipe hole that said first end of said heat pipe is coupled with said heat dissipative fin at said heat dissipative fin pipe hole thereof for heat conduction.

7. The heat dissipative cooling device, as recited in claim 5, wherein each of said heat dissipative fins has a heat dissipative fin pipe hole that said first end of said heat pipe is coupled with said heat dissipative fin at said heat dissipative fin pipe hole thereof for heat conduction.

8. The heat dissipative cooling device, as recited in claim 6, further comprising a metal end cover positioning at said heat dissipative fin at the outermost position and covering at said first end of each of said heat pipes for spreading heat from said first end of said heat pipe so as to prevent heat from being accumulated at said first end of said heat pipe.

9. The heat dissipative cooling device, as recited in claim 7, further comprising a metal end cover positioning at said heat dissipative fin at the outermost position and covering at said first end of each of said heat pipes for spreading heat from said first end of said heat pipe so as to prevent heat from being accumulated at said first end of said heat pipe.

10. The heat dissipative cooling device, as recited in claim 4, further comprising a chassis mould module coupling at said second end of each of said heat pipes, wherein said chassis mould module comprises a fixed chassis mold having a heat pipe groove receiving said second end of each of said heat pipes therein, and a top cover covering at said fixed chassis mold to secure said second end of each of said heat pipes in said heat pipe groove.

11. The heat dissipative cooling device, as recited in claim 5, further comprising a chassis mould module coupling at said second end of each of said heat pipes, wherein said chassis mould module comprises a fixed chassis mold having a heat pipe groove receiving said second end of each of said heat pipes therein, and a top cover covering at said fixed chassis mold to secure said second end of each of said heat pipes in said heat pipe groove.

12. The heat dissipative cooling device, as recited in claim 9, further comprising a chassis mould module coupling at said second end of each of said heat pipes, wherein said chassis mould module comprises a fixed chassis mold having a heat pipe groove receiving said second end of each of said heat pipes therein, and a top cover covering at said fixed chassis mold to secure said second end of each of said heat pipes in said heat pipe groove.

13. The heat dissipative cooling device, as recited in claim 10, wherein said chassis mould module further comprises a front end cover covering at a front end of said fixed chassis mold to enclose said second end of said heat pipe for preventing heat loss at said second end of said heat pipe.

14. The heat dissipative cooling device, as recited in claim 11, wherein said chassis mould module further comprises a front end cover covering at a front end of said fixed chassis mold to enclose said second end of said heat pipe for preventing heat loss at said second end of said heat pipe.

15. The heat dissipative cooling device, as recited in claim 12, wherein said chassis mould module further comprises a front end cover covering at a front end of said fixed chassis mold to enclose said second end of said heat pipe for preventing heat loss at said second end of said heat pipe.

16. The heat dissipative cooling device, as recited in claim 4, wherein said second end of each of said heat pipes is adapted for coupling with a thermoelectric cooling chip in condition that when said second end of each of said heat pipes is coupled at a hotter side of said thermoelectric cooling chip, said heat pipes transmit heat from said second end to said first end, such that said air flow is generated by said fan for dissipating said heat through said heat dissipative fins, and when said second end of each of said heat pipes is coupled at a colder side of said thermoelectric cooling chip, said first end of each of said heat pipes is rapidly cooled down, such that said air flow is generated by said fan for forming a colder air flow.

17. The heat dissipative cooling device, as recited in claim 9, wherein said second end of each of said heat pipes is adapted for coupling with a thermoelectric cooling chip in condition that when said second end of each of said heat pipes is coupled at a hotter side of said thermoelectric cooling chip, said heat pipes transmit heat from said second end to said first end, such that said air flow is generated by said fan for dissipating said heat through said heat dissipative fins, and when said second end of each of said heat pipes is coupled at a colder side of said thermoelectric cooling chip, said first end of each of said heat pipes is rapidly cooled down, such that said air flow is generated by said fan for forming a colder air flow.

18. The heat dissipative cooling device, as recited in claim 15, wherein said second end of each of said heat pipes is adapted for coupling with a thermoelectric cooling chip in condition that when said second end of each of said heat pipes is coupled at a hotter side of said thermoelectric cooling chip, said heat pipes transmit heat from said second end to said first end, such that said air flow is generated by said fan for dissipating said heat through said heat dissipative fins, and when said second end of each of said heat pipes is coupled at a colder side of said thermoelectric cooling chip, said first end of each of said heat pipes is rapidly cooled down, such that said air flow is generated by said fan for forming a colder air flow.

* * * * *